United States Patent [19]

Moen et al.

[11] Patent Number: 5,011,037

[45] Date of Patent: Apr. 30, 1991

[54] CONTAINER END MEMBER

[75] Inventors: Bruce A. Moen, Golden; Harold Cook, Jr., Evergreen, both of Colo.

[73] Assignee: Adolph Coors Company, Golden, Colo.

[21] Appl. No.: 443,510

[22] Filed: Nov. 30, 1989

[51] Int. Cl.[5] ..... B65D 17/34

[52] U.S. Cl. ..... 220/271; 220/269

[58] Field of Search ..... 220/269, 270, 271

[56] References Cited

U.S. PATENT DOCUMENTS

| | | | |
|---|---|---|---|
| 3,221,924 | 12/1965 | Harvey et al. . | |
| 3,273,745 | 9/1966 | Stec . | |
| 3,301,434 | 1/1967 | Harvey et al. . | |
| 3,302,818 | 2/1967 | Balocca et al. . | |
| 3,307,737 | 3/1967 | Harvey et al. . | |
| 3,313,446 | 4/1967 | Harvey . | |
| 3,326,405 | 6/1967 | Fraze . | |
| 3,434,622 | 3/1969 | Czegledy . | |
| 3,441,167 | 4/1969 | Balocca . | |
| 3,485,410 | 12/1969 | Boik . | |
| 3,593,876 | 7/1971 | Fraze . | |
| 3,627,168 | 12/1971 | Fraze . | |
| 3,662,914 | 5/1972 | Slade . | |
| 3,720,348 | 3/1973 | Jakobsen . | |
| 3,741,432 | 6/1973 | Werth et al. . | |
| 3,804,287 | 4/1974 | Balocca et al. . | |
| 3,858,747 | 1/1975 | Wharton . | |
| 3,880,316 | 4/1975 | Martella . | |
| 3,886,881 | 6/1975 | Pearce et al. . | |
| 3,888,199 | 6/1975 | Herrmann . | |
| 3,970,212 | 7/1976 | Brown . | |
| 3,982,657 | 9/1976 | Keller et al. . | |
| 4,023,703 | 5/1977 | Strobe et al. . | |
| 4,032,034 | 6/1977 | Willis . | |
| 4,081,104 | 3/1978 | Rising et al. . | |
| 4,105,134 | 8/1978 | Debenham et al. . | |
| 4,106,662 | 8/1978 | Strobe et al. . | |
| 4,119,050 | 10/1978 | Klein . | |
| 4,134,517 | 1/1979 | Rhoades . | |
| 4,135,637 | 1/1979 | Hannula . | |
| 4,136,797 | 1/1979 | Potts . | |
| 4,154,184 | 5/1979 | Keller et al. . | |
| 4,155,480 | 5/1979 | Debenham et al. . | |
| 4,205,760 | 6/1980 | Hasegawa | 220/271 |
| 4,213,538 | 7/1980 | Boardman . | |
| 4,318,494 | 3/1982 | Heyn | 220/271 |
| 4,355,935 | 10/1982 | Klein . | |
| 4,405,056 | 9/1983 | Patterson . | |
| 4,572,398 | 2/1986 | Juty . | |
| 4,576,306 | 3/1986 | Kelsely et al. . | |
| 4,701,090 | 10/1987 | Smith . | |
| 4,705,186 | 11/1987 | Barrash . | |

*Primary Examiner*—Stephen P. Garbe
*Assistant Examiner*—Nova Stucker
*Attorney, Agent, or Firm*—Klaas & Law

[57] ABSTRACT

A container end member is provided and has a first severable tab portion which is defined by a score line groove and has an integral hinge portion for permanently securing it to the container end member and a force applying tab portion permanently pivotally mounted on the container end member and used to apply a force on the first severable tab portion to form a pour opening in the container end member and a second severable tab portion having an integral hinge portion for permanently securing it to the container end member and having a raised surface projecting outwardly from the container end member so that a force may be applied thereto to sever the second severable tab portion and form a vent opening in the container end member.

11 Claims, 1 Drawing Sheet

CONTAINER END MEMBER

FIELD OF THE INVENTION

This invention relates generally to an end member for a container and more specifically to such a container end member that is provided with a main opening for removing the contents within the container and another opening serving to relieve pressure or vacuum within the container or to form a vent opening.

BACKGROUND OF THE INVENTION

Many patents have been issued for end members for containers wherein the end member is provided with two openings, a main opening for removing the contents of the container and another opening serving to relieve pressure or vacuum within the container or to provide a vent. These patents fall into the following categories.

Pull tab completely removed: U.S. Pat. Nos. 3,221,924; 3,273,745; 3,301,434; 3,302,818; 3,307,737; 3,313,446; 3,326,405; 3,434,622; 3,441,167; 4,135,637; 4,405,056; 4,705,186;

Pressure relief and entire lid removed: U.S. Pat. Nos. 3,485,410; 3,593,876; 3,720,348;

Resealable tab: U.S. Pat. Nos. 3,804,287; 3,858,747; 4,572,398; 4,576,306;

Pull tab and panel removed: U.S. Pat. Nos. 3,627,168; 3,662,914;

Push in tab: U.S. Pat. Nos. 3,741,432; 3,880,316; 3,886,881; 3,888,199; 3,970,212; 3,982,657; 4,023,703; 4,032,034; 4,081,104; 4,105,134; 4,106,662; 4,119,050; 4,134,517; 4,136,797; 4,154,184; 4,155,480; 4,213,538; 4,355,935; 4,701,090.

For many years, the most commonly used beverage containers have end members with a stay on tab which is used to apply a force to a severable tab portion to form an opening in the end member and after such opening has been formed, both the severable tab portion and the stay on tab remain attached to the end member. To applicants' knowledge, no container end member having a stay on tab has been provided with means of some nature for forming a vent opening therein. While some consumers have used a "church key" to form such a vent opening, it is more desirable to have an easily openable vent opening formed in the end member so that the vent opening can be formed whenever desired.

BRIEF DESCRIPTION OF THE INVENTION

This invention provides an end member for a beverage container which end member has a stay on tab for applying a force to a first severable tab portion to form a pour opening in the end member and a second severable tab portion having a raised surface so that a force may be applied thereto to form a vent opening in the end member.

In a preferred embodiment of the invention, an end member for a beverage container is provided and comprises a central end wall portion having a first severable tab portion formed therein and defined by score line groove means having spaced apart ends to form a hinge portion for the first severable tab portion. Force applying means are provided for applying an axially inwardly directed force on the first severable tab portion to sever it along the score line groove means to form a pour opening in the end member. Pivot means are permanently mounted on the central end wall portion for pivotally mounting the force applying means. The force applying means has an abutment end portion on one side of the pivot means for contacting the first severable tab portion and a handle portion on the other side of the pivot means so that, when an axially outwardly directed force is applied to the handle portion, the abutment end portion will apply an axially inwardly directed force on the first severable tab portion to form the pour opening. The pivot means keeps the force applying means secured to the central end wall portion and the hinge portion keeps the first severable tab portion secured to the central end wall portion. A second severable tab portion is formed in the central end wall portion at a location that is spaced from the first severable tab portion and has a hinge portion that is integral with the central end wall portion. The second severable tab portion has a raised surface projecting axially outwardly from the central end wall portion so that an axially inwardly directed force may be applied thereto to pivot the second severable tab portion about the hinge portion to form a vent opening.

BRIEF DESCRIPTION OF THE DRAWINGS

Illustrative and presently preferred embodiments of the invention are shown in the accompanying drawings in which.

DETAILED DESCRIPTION OF THE INVENTION

Figure 1:
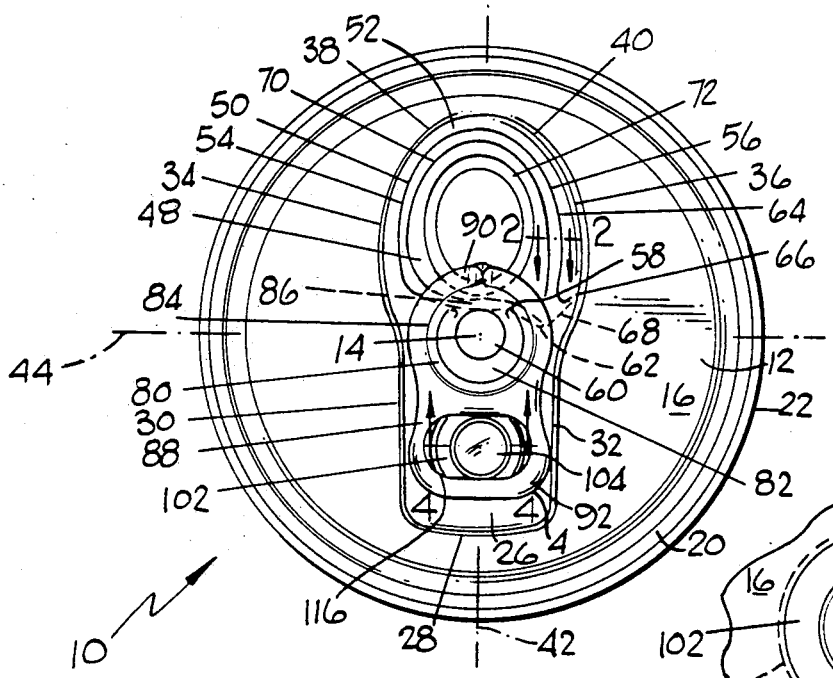
FIG. 1 is a top plan view of a container end member of this invention.
Figure 2:
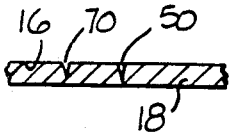
FIG. 2 is a cross-sectional view taken on the line 2—2 of FIG. 1.

In FIG. 1, there is illustrated a container end member 10, formed from a blank of sheet material such as, for example, an aluminum alloy of approximately 0.0108 inch in thickness having a central end wall portion 12 and a central axis 14, to provide an outer surface 16 and an inner surface 18, FIG. 2, when the container end member 10 is used with a container (not shown). The central end wall portion 12 is axially inwardly off-set from an annular exterior rim portion 20 having an axially outwardly facing end surface 22 and integrally connected to a generally radially inwardly directed flange portion 24 which is also integral with the central end wall portion 12.

A generally rectangularly shaped, axially inwardly depressed panel portion 26 is formed in the central end wall portion 12 and extends downwardly in an axially inward direction from the central end wall portion 12. The depressed panel portion 26 has an axially inwardly inclined outer end portion 28, two spaced apart generally parallel elongated axially inwardly inclined side edge portions 30 and 32 and two spaced apart curved, axially inwardly inclined edge portions 34 and 36 having central end portions 38 and 40. The container end member 10 has a first diametrical reference line 42 which bisects the depressed panel portion 26 and a second diametrical reference line 44 which is perpendicular to the first diametrical reference line 42.

A first severable tab portion 48 is located generally between the curved edge portions 34 and 36. The configuration of the severable tab portion 48 is defined by an outer score line groove 50 in the outer surface 16 of the depressed panel portion 26. The outer score line groove 50 has a curved portion 52 extending across the first diametrical reference line 42 and located adjacent to the end portions 38 and 40 of the depressed panel portion 26 and a pair of spaced curved side portions 54 and 56 on opposite sides of the first diametrical reference line 42. The curved side portion 54 has a terminal end portion 58 extending across the first diametrical reference line 42 and located a relatively small distance from a portion of the periphery of a central rivet 60, described below, and having a terminal end 62. The curved side portion 56 has a terminal end portion 64 having a terminal end 66 that is a quarter of a circle having a radius of about 0.030 inch. The curved end portion 52 and curved side portions 54 and 56 comprise the main body portion of the outer score line groove 50. An integral hinge portion 68 extends between the terminal end portion 62 and the terminal end 66. An inner score line groove 70, which is an insurance score line groove, has a configuration slightly smaller than the outer score line groove 50. Also, as illustrated in FIG. 2, the depth of the inner score line groove 70 is substantially less than the depth of the outer score line groove 50. The depth of the score line groove is expressed by the score residual, which is the material remaining in the groove, and for score line groove 50 the score residual is about 0.0032 inch and for score line groove 70, the score residual is about 0.0066 inch. A closed reinforcing rib 72 extends in an axially outward direction from the first severable tab portion 48 and has a configuration similar to a portion of, but slightly smaller than, the inner score line groove 70. The closed reinforcing rib 72 is bisected by the first diametrical reference line 42. The terminal end portion 62 connects the outer score line groove 50 and the inner score line groove 70 and has a radius of about 0.025 inch.

Force applying means are provided for applying an axially inwardly directed force on the first severable tab portion 48 so as to sever it along the outer score line groove 50 to form a pour opening in the central end wall portion 12. The force applying means comprise a central body portion 80 having an attachment portion 82 that is partially cut away from the central body portion 80 by a cut line 84 leaving a hinge portion 86. The attachment portion 82 has a central opening (not shown) so that it may be securely attached to the central end wall portion 12 by the rivet 60. A rigid lever portion 88 is integral with the hinge portion 86 and central body portion 80 and has an abutment end portion 90 and a handle end portion 92 so that a finger may be used to move the handle end portion 92 in an axially outward direction to pivot the rigid lever portion 88 around the hinge portion 86 s that the abutment end portion 90 applies an axially inwardly directed force on the first severable tab portion 48 to sever it along the outer score line groove 50. The hinge portion 68 retains the severed severable tab portion on the central end wall portion 12 and the hinge portion 86 retains the rigid lever portion 88 on the central end wall portion 12. Although the end member 10 has been described as having the depressed panel portion 26, it is understood that this is for illustrative purposes only and is not required for the purposes of this invention.

Figure 3:
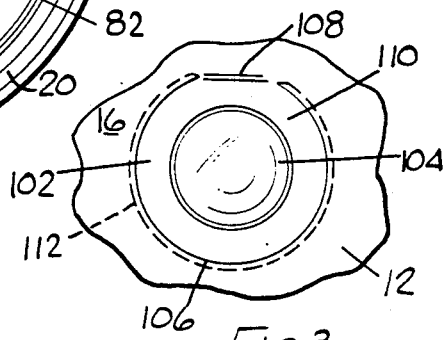
FIG. 3 is an enlarged view of the second severable tab portion.
Figure 4:
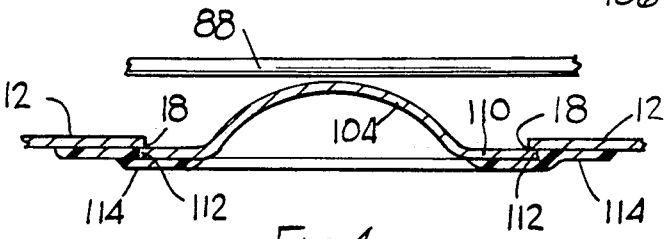
FIG. 4 is a cross-sectional view taken on the line 4—4 of FIG. 1.

A second severable tab portion, FIGS. 3 and 4, is provided and is used to form a vent opening in the central end wall portion 12. The second severable tab portion 102 is similar to the release vent tab in U.S. Pat. No. 3,741,432 which is incorporated herein by reference thereto. A raised surface 104 projects axially outwardly from the central end wall portion 12. A cut 106 partially surrounding the raised surface 104 is made in the central end wall portion 12 leaving a hinge portion 108. The cut away portion 110 is enlarged so as to form a lip 112 underlying the bottom surface 18 of the central end wall portion 12 bordering the cut 106. A sealant 114 is used to cover the overlapping portions. An opening 116 is formed in the handle portion to provide access to the raised surface 104. When it is desired to form the vent opening in the central end wall portion 12, an axially inwardly directed force is applied to the raised surface 104 to pivot the second severable tab portion 102 around the hinge portion 108 to form the vent opening. The hinge portion 108 retains the second severable tab portion 102 on the central end wall portion 12 after the vent opening has been formed.

The lever portion 88 surrounding the opening 116 has a thickness in the axial direction that is greater than the distance that the raised surface 104 projects from the depressed portion 26 to minimize the possibility of inadvertently moving the second severable tab portion 102 in an axially inward direction.

Figure 5:
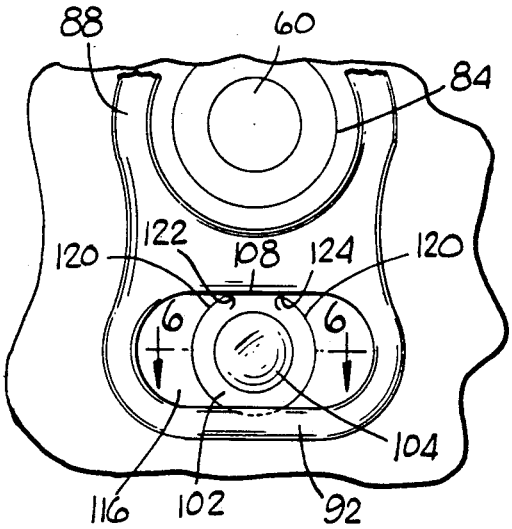
FIG. 5 is a top plan view of a modification of the second severable tab portion.
Figure 6:
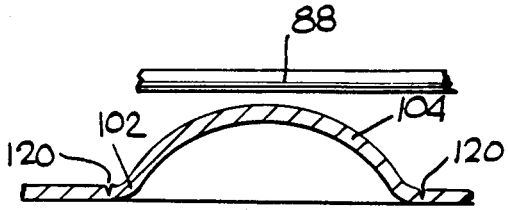
FIG. 6 is a cross-sectional view taken on the line 6—6 of FIG. 5.

In the embodiment of the invention illustrated in Figs. 5 and 6, a score line groove means 120 partially surrounds the raised surface 104 and have terminal ends 122 and 124 that extend in directions away from each other to ensure that the hinge portion 108 remains after the vent opening is formed. The vent opening of FIGS. 5 and 6 is formed in the same manner as the vent opening in FIGS. 3 and 4 by applying an axially inwardly directed force on the raised surface 104.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A container end member or the like for sealed association with a container member to provide a sealed container and which is provided with a system for forming openings therein comprising:

a one piece end member having a cylindrical peripheral end surface and a central axis;

an annular exterior rim portion on said end member for sealed association with the container member;

a central end wall portion integrally connected to said annular exterior rim portion and extending generally transversely to said central axis and having an outer surface and an inner surface;

a first severable tab portion in and integrally connected to said central end wall portion;

a first hinge portion integral with said central end wall portion and having spaced apart ends;

severable score line groove means having ends adjacent to said spaced apart ends of said first hinge portion and defining said first severable tab portion so that said first severable tab portion may be severed from said central wall portion in response to applied axially inwardly directed forces and form a pour opening in said central end wall portion;

force applying means for applying said axially inwardly directed forces on said severable tab portion;

pivot means permanently mounted on said central end wall portion for pivotally mounting said force applying means on said central end wall portion;

said force applying means having an abutment end portion for contacting said first severable tab portion and a handle end portion so that, when an axially outwardly directed force is applied to said handle portion, said force applying means will pivot about said pivot means so that said abutment end portion will apply said axially inwardly directed forces to said first severable tab portion to sever said first severable tab portion along said first score line groove means and form said pour opening in said central end wall portion;

a second severable tab portion in and integrally connected to said central end wall portion;

said second severable tab portion being located in said central end wall portion at a location spaced from said first severable tab portion;

a second hinge portion integral with said central end wall portion and said second severable tab portion;

said second severable tab portion having a raised surface projecting axially outwardly from said central end wall portion so that an axially inwardly directed force may be applied thereto to sever said second severable tab portion and form a vent opening in said central end wall portion; and retaining means for retaining said first severable tab portion, said force applying means and said second severable tab portion on said end member after said pour and vent openings have been formed.

2. The invention as in claim 1 and further comprising:

said handle portion having an opening formed therein; and said raised surface being located within said handle opening before said handle portion has been moved in said axially outwardly direction.

3. The invention as in claim 2 wherein:

said handle portion has a thickness in an axial direction greater than the distance said raised surface projects from said central end wall portion to minimize the possibility of inadvertently moving said second severable tab portion in said axially inward direction.

4. The invention as in claim 1 and further comprising:

a diametrical line extending across said central end wall portion and passing through said first severable tab portion, said pivot means and said second severable tab portion; and said pivot means being located between said first and second severable tab portions.

5. The invention as in claim 4 and further comprising:

said handle portion having an opening formed therein; and said raised surface being located within said handle opening before said handle portion has been moved in said axially outwardly direction.

6. The invention as in claim 5 wherein: said handle portion has a thickness in an axial direction greater than the distance said raised surface projects from said central end wall portion to minimize the possibility of inadvertently moving said second severable tab portion in said axially inward direction.

7. The invention as in claim 6 wherein: said end member is formed from aluminum.

8. The invention as in claim 1 wherein said retaining means comprises:

said first and second hinge portions of said first and second severable tab portion; and said pivot means for said force applying means.

9. The invention as in claim 8 and further comprising:

a diametrical line extending across said central end wall portion and passing through said first severable tab portion, said pivot means and said second severable tab portion; and said pivot means being located between said first and second severable tab portions.

10. The invention as in claim 9 and further comprising:

said handle portion having an opening formed therein; and said raised surface being located within said handle opening before said handle portion has been moved in said axially outwardly direction.

11. The invention as in claim 10 wherein:

said handle portion has a thickness in an axial direction greater than the distance said raised surface projects from said central end wall portion to minimize the possibility of inadvertently moving said second severable tab portion in said axially inward direction.

* * * * *